US008822868B2

(12) United States Patent
Kehr et al.

(10) Patent No.: US 8,822,868 B2
(45) Date of Patent: Sep. 2, 2014

(54) GAS-INSULATED HIGH-VOLTAGE POWER CIRCUIT BREAKER

(71) Applicants: Timo Kehr, Birrhard (CH); Olaf Hunger, Schaffhausen (CH); Jurg Nufer, Dubendorf (CH); Daniel Ohlsson, Wettingen (CH); Navid Mahdizadeh, Baden (CH); Javier Mantilla, Baden (CH); Stephan Grob, Baden (CH); Mathias-Dominic Buergler, Baden-Dattwil (CH); Nicola Gariboldi, Nussbaumen (CH)

(72) Inventors: Timo Kehr, Birrhard (CH); Olaf Hunger, Schaffhausen (CH); Jurg Nufer, Dubendorf (CH); Daniel Ohlsson, Wettingen (CH); Navid Mahdizadeh, Baden (CH); Javier Mantilla, Baden (CH); Stephan Grob, Baden (CH); Mathias-Dominic Buergler, Baden-Dattwil (CH); Nicola Gariboldi, Nussbaumen (CH)

(73) Assignee: ABB Technology AG (CH)

( * ) Notice: Subject to any disclaimer, the term of this patent is extended or adjusted under 35 U.S.C. 154(b) by 0 days.

(21) Appl. No.: 14/029,274

(22) Filed: Sep. 17, 2013

(65) Prior Publication Data

US 2014/0014623 A1 Jan. 16, 2014

Related U.S. Application Data

(63) Continuation of application No. PCT/EP2011/054068, filed on Mar. 17, 2011.

(51) Int. Cl.

| | |
|---|---|
| ***H01H 33/867*** | (2006.01) |
| ***H01H 33/86*** | (2006.01) |
| ***H01H 33/91*** | (2006.01) |
| *H01H 33/90* | (2006.01) |

(52) U.S. Cl.

CPC ..... *H01H 33/86* (2013.01); *H01H 2033/908* (2013.01); *H01H 33/901* (2013.01); *H01H 33/91* (2013.01); *H01H 2033/906* (2013.01)

USPC ..... 218/66

(58) Field of Classification Search

USPC ..... 218/48–66

See application file for complete search history.

(56) References Cited

U.S. PATENT DOCUMENTS 5,561,280 A * 10/1996 Blatter ..... 218/59
5,589,673 A 12/1996 Lehmann et al.

(Continued)

FOREIGN PATENT DOCUMENTS

DE 2316009 A1 10/1974
DE 4107673 A1 9/1992

(Continued)

OTHER PUBLICATIONS

International Preliminary Report on Patentability & English Translation of the Written Opinion Application No. PCT/EP2011/054068 Issued: Sep. 17, 2013 8 pages.

(Continued)

*Primary Examiner* — Truc Nguyen

(74) *Attorney, Agent, or Firm* — St. Onge Steward Johnston & Reens LLC

(57) ABSTRACT

A simplified construction of a gas-insulated high-power circuit breaker with a saving of components is achieved by at least one hole and at least one leaf spring, which is fastened on one side and is elastically bendable in dependence upon the pressure of the insulating gas in the compression volume, being formed in a valve plate of the valve. The bendable spring closes off the hole when the circuit breaker closes and opens it when the circuit breaker opens as soon as the pressure of the compressed insulating gas in the compression volume exceeds the value of the gas pressure in the low-pressure chamber by at least two bar.

12 Claims, 5 Drawing Sheets

(56) References Cited

U.S. PATENT DOCUMENTS

| | | | | |
|---|---|---|---|---|
| 5,767,471 | A * | 6/1998 | Blatter et al. | 218/60 |
| 6,207,917 | B1 * | 3/2001 | Lehmann et al. | 218/43 |
| 6,462,295 | B1 * | 10/2002 | Knobloch et al. | 218/48 |
| 8,410,388 | B2 * | 4/2013 | Kriegel et al. | 218/66 |
| 2010/0326958 | A1 | 12/2010 | Gregoire et al. | |
| 2011/0163069 | A1 * | 7/2011 | Ohlsson et al. | 218/66 |
| 2011/0192821 | A1 * | 8/2011 | Dufournet | 218/54 |
| 2013/0056444 | A1 * | 3/2013 | Cernat | 218/51 |

FOREIGN PATENT DOCUMENTS

| | | | |
|---|---|---|---|
| DE | 4211159 | A1 | 10/1993 |
| EP | 0296363 | A2 | 12/1988 |
| EP | 0634049 | B1 | 5/1996 |
| EP | 1079404 | A2 | 2/2001 |
| EP | 1939910 | A1 | 7/2008 |
| EP | 2270828 | A1 | 1/2011 |
| EP | 2299464 | A1 | 3/2011 |
| WO | 9320573 | A1 | 10/1993 |
| WO | 9912177 | A1 | 3/1999 |

OTHER PUBLICATIONS

International Search Report & Written Opinion of the International Searching Authority Application No. PCT/EP2011/054068 Completed: Jan. 12, 2012; Mailing Date: Jan. 18, 2012 10 pages.

* cited by examiner

GAS-INSULATED HIGH-VOLTAGE POWER CIRCUIT BREAKER

FIELD OF THE INVENTION

The invention relates to the field of high voltage technology and refers to a gas-insulated high-voltage power circuit breaker, which can be used within the voltage range of between several kV and several hundred kV.

BACKGROUND OF THE INVENTION

Such a circuit breaker, also called a compressed gas-blast circuit breaker, is used especially in power distribution networks. It is designed in such a way that in the event of a separating of the contacts, or in the case of a short circuit, an arc is blasted with gas and consequently quenched as quickly as possible. The gas which is used most for this purpose is $SF_6$ (sulphur hexafluoride).

A circuit breaker of the type referred to in the introduction is described in DE 4211159 A1 and U.S. Pat. No. 5,589,673 A. In the case of this circuit breaker, a pressure chamber, in which the arc is created, is connected in a valve-controlled manner to a compression chamber. The compression chamber is connected to a low-pressure chamber via an overpressure valve and a replenishment valve. The valves are arranged in a ring-like and abutting manner with an overlapping zone. The overpressure valve, on the low-pressure chamber side, is pressed by a spring against a valve holder in the direction of the compression volume. Gas can therefore flow from the compression volume into the low-pressure chamber only when its pressure is higher than the spring force. This type of construction, however, is relatively complicated and requires a large number of elements.

A circuit breaker of the type referred to in the introduction is also described in the earlier European application 09170549.1, the publication of which was provided on Mar. 3, 2011 with publication number 2299464.

EP 2270828 A1 furthermore describes a high-voltage power circuit breaker which is constructed as a self-blast circuit breaker, in which a check valve is arranged between two volumes of its extinction chamber. This valve has at least one small metallic, flexible plate which can move between a valve seat and a stop of the valve within its elastic deformability. The valve is designed so that with opening of the circuit breaker it enables the feed of compressed, cool gas from a compression volume into a heating volume which is subjected to the action of arc gases, but prevents hot arc gases flowing from the heating volume into the compression volume. Therefore, for the at least one small plate a material which can withstand temperatures of up to 2500° C. is used.

Reference is also to be made to EP 1939910 A1. This document discloses a compressed gas circuit breaker with a plurality of contacts which are movable in relation to each other. Arranged around a first contact is a blast volume which is connected via a blast passage to an arcing zone. The blast volume is isolated from a low-pressure chamber by means of a separating element. In the separating element provision is made for a throughflow opening which serves for the gas exchange between the blast volume and the low-pressure chamber.

SUMMARY OF THE INVENTION

By means of the present invention, the type of construction of the gas-insulated high-voltage power circuit breaker of the type referred to in the introduction is to be simplified and the number of components which are required is to be reduced.

The gas-insulated circuit breaker according to the invention comprises a compression device, operated by a drive of the circuit breaker, with a compression volume which is filled with insulating gas and in which the insulating gas is compressed, forming a quenching gas, when the valve opens, a low-pressure volume which is filled with insulating gas, and a valve which interconnects the compression chamber and the low-pressure chamber, through which valve insulating gas flows from the low-pressure volume into the compression volume when the circuit breaker closes and through which insulating gas flows from the compression volume in the reverse direction into the low-pressure volume when the circuit breaker opens above a threshold value of the quenching gas pressure, the valve having the following elements:

- a valve body, which is guided through the wall of the compression chamber, with a gas passage which connects the compression volume and the low-pressure volume and with a valve seat which encompasses the gas passage,
- a valve plate which is operated by the insulating gas, is movably mounted in the valve body and sits on the valve seat when the circuit breaker opens, and also
- a stop which is integrated into the valve body and limits the movement of the valve plate when the circuit breaker closes.

The valve plate has at least one hole and at least one leaf spring which is fastened on one side, is elastically bendable in dependence upon the pressure of the insulating gas in the compression volume, closes off the hole when the circuit breaker closes, opens the hole when the circuit breaker opens, and limits a flow passage, which is guided through the hole, for the insulating gas which discharges from the compression volume as soon as the pressure of the compressed insulating gas in the compression volume exceeds the value of the gas pressure in the low-pressure chamber by at least two bar.

Compared with the closest prior art, in which the valve which is arranged between compression volume and low-pressure volume has two annular overlapping valve plates and a valve spring, the valve in the case of the circuit breaker according to the invention requires only a single valve plate. Compared with the prior art, a saving is therefore made on one valve plate and one spring. Since instead of two overlapping valve plates and one spring for adjustment only a single valve plate is now to be built into the valve, the circuit breaker according to the invention can be produced and maintained in a significantly easier manner. Since this single valve plate has at least one hole and one leaf spring which normally closes off the hole and only opens the hole above an overpressure of two bar as a result of elastic bending and in the process connects the compression volume to the low-pressure volume, not only the targeted filling of the compression volume with fresh insulating gas during the closing of the circuit breaker is achieved with this single valve plate, but with opening of the circuit breaker an overpressure in the compression volume which amounts to more than two bar is effectively limited at the same time. The leaf spring has a relatively high spring constant and also a strong restoring force accordingly. Therefore, it is not necessary to limit the travel of the leaf spring itself when high overpressures occur by means of a fixed stop which limits the deflection of the leaf spring.

The leaf spring can be formed into the valve plate by means of at least one incision. This incision can be directed perpendicularly to the surface of the valve plate. Alternatively, at least one section of the at least one incision can be directed in an inclined manner in relation to the surface of the valve plate. The inclination angle should then be 60° at most.

The valve plate can be produced from a spring steel sheet, the thickness of which in relation to the length of the leaf spring is selected so that with deflection of the leaf spring a plastic deformation is avoided and the hole is opened when the threshold value is exceeded.

The valve plate can be designed as an annular disk and the at least one leaf spring can be constructed as a circle section with regard to a middle point of the annular disk and can have at least three sides cut into the annular disk, of which at least one is radially oriented and at least two are directed concentrically.

The annular disk can have a multiplicity of leaf springs which are formed in each case as a circle section with regard to the middle point of the annular disk and have in each case at least three sides which are cut into the annular disk, of which at least one is radially oriented and at least two are directed concentrically, wherein each two of the leaf springs are arranged in a mirror-image manner in relation to each other with regard to a diameter line of the annular disk.

In the case of a circuit breaker with a heating volume which is connected to the compression volume via a check valve for accommodating arc gases, the valve plate and the at least one leaf spring can be formed from a standard spring steel which is realized as unalloyed or low-alloy high-grade steel. In contrast to the prior art according to EP 22 70 828, in which a check valve which is arranged between heating volume and compression volume has a valve flap consisting of a material which can withstand temperatures of up to 2500° C., a standard spring steel is suitable only for use at operating temperatures of up to approximately 300° C. at most.

BRIEF DESCRIPTION OF THE DRAWINGS

Further developments, advantages and applications of the invention are gathered from the now following description with reference to the figures. In this case in the drawings.

DETAILED DESCRIPTION OF THE INVENTION

The designations which are used in the figures and their meaning are listed in summary in the list of designations. Parts which are not essential for the understanding of the invention are not shown in some cases. The described embodiments are by way of example for the subject matter of the invention and have no limiting effect, rather the invention can also be implemented in another manner within the scope of the patent claims.

Figure 1:
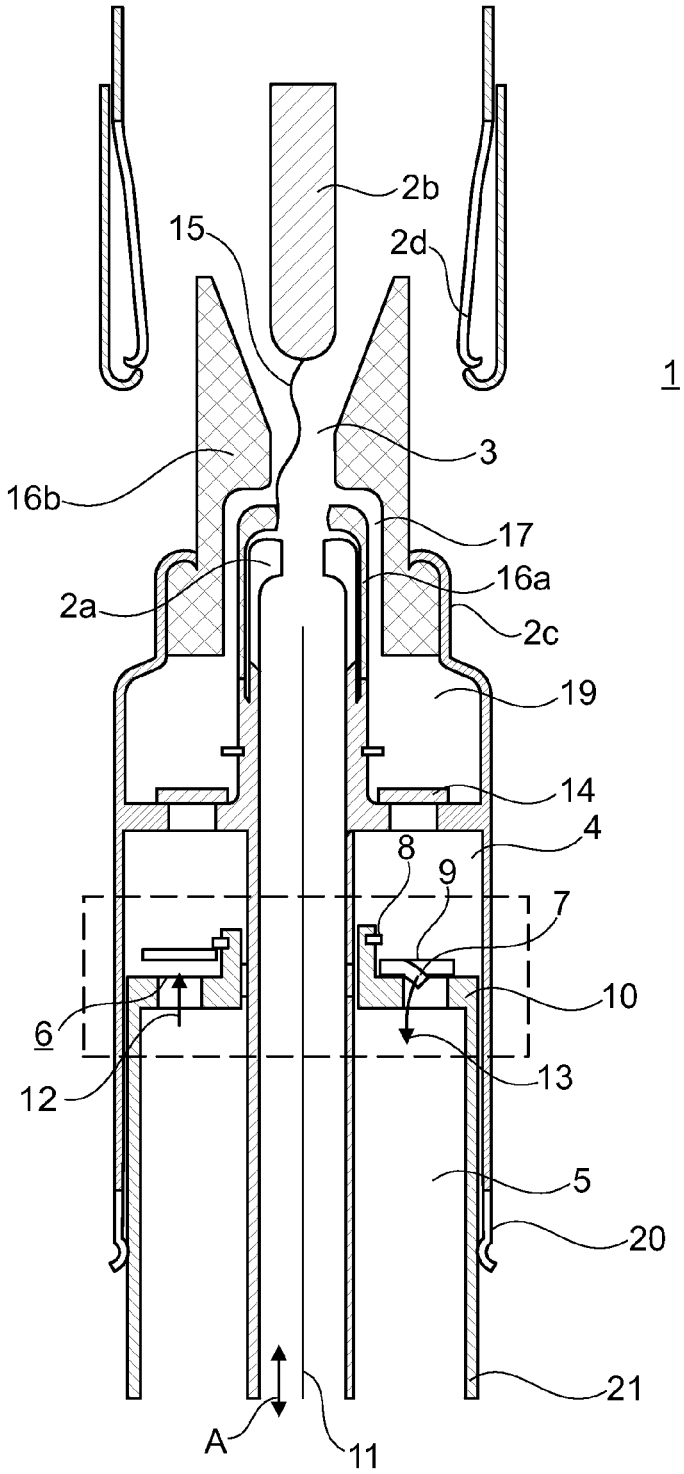
FIG. 1 shows a cross section along the longitudinal axis of an embodiment of the high-voltage power circuit breaker according to the invention which is realized as a self-blast circuit breaker.

FIG. 1 shows a cross section along a longitudinal axis 11 of an embodiment of a gas-insulated high-voltage power circuit breaker 1 according to the invention. The circuit breaker is constructed as a self-blast circuit breaker and has a housing, not shown, which is filled with an insulating gas, such as $SF_6$ in particular, of several bar of pressure, the housing externally delimiting a low-pressure volume 5. Shown on the left of the longitudinal axis 11 is a first operating state of the circuit breaker 1 and shown on the right of the longitudinal axis 11 is a second operating state of the circuit breaker 1, which states are subsequently called filling operation and overpressure operation.

The circuit breaker 1 has a nominal current contact 2*c* which is movable in the direction of the longitudinal axis 11 of the circuit breaker 1 in such a way that it can make contact with a nominal current contact 2*d*. The circuit breaker also has an arcing contact 2*a* which is movable in the direction of the longitudinal axis 11 of the circuit breaker 1 in such a way that it can make contact with an arcing contact 2*b*. An arc, which is created with interruption of a current after the separation of the two arcing contacts 2*a*, 2*b*, is identified by the designation 15. With the interruption of an operating current, the arc 15 is weak as a rule. With the interruption of a short-circuit current, however, very intense arcs 15 can occur. These two possibilities are expanded upon in the further course of the description because they require a separate procedure in the quenching of the arc 15.

The quenching of the arc 15 is carried out by blasting of the arc 15 which burns in an arcing zone 3 by means of a quenching gas which has a higher pressure compared with the insulating gas which is present in the low-pressure volume 5. Quenching gas can be formed by means of the arc 15, the arc gases of which are stored in a heating volume 19 in the high-current phase of the current which is to be shut off and with zero crossing of current flows through a heating passage 17 into the arcing zone 3 and cools the arc 15. The heating passage 17 is formed typically between an auxiliary nozzle 16*a* and a main nozzle 16*b*. Quenching gas, with the opening of the circuit breaker, can also be provided at the same time in a compression volume 4 which is part of a compression device which is operated by a drive A of the circuit breaker.

Instead of being designed as a self-blast circuit breaker, the circuit breaker according to the invention can also be designed as a buffer circuit breaker. The arc gases can then directly enter the compression volume 4 from the arcing zone when the circuit breaker opens.

Figure 1A:
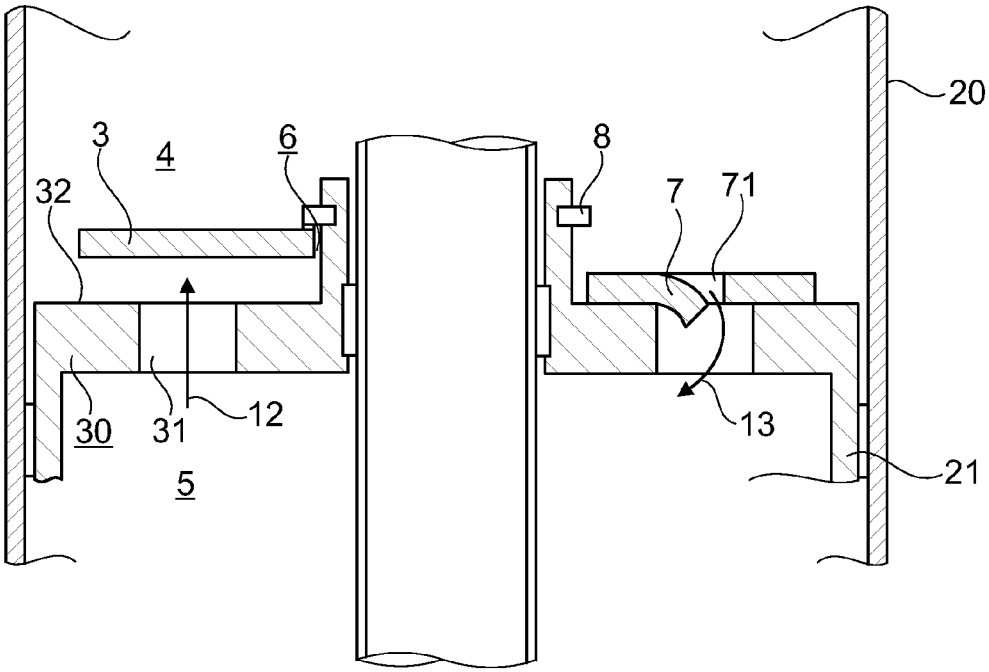
FIG. 1*a* shows an enlargement of a region of the circuit breaker according to FIG. 1 which is shown boxed in FIG. 1, FIGS. 2 to 4 show in plan view in each case embodiments of a valve plate of a valve of the circuit breaker according to FIG. 1.

In the case of the self-blast circuit breaker which is shown in FIGS. 1 and 1*a* the heating volume 19 is separated from the compression volume 4 by means of a check valve 14. Both in the case of the self-blast circuit breaker and in the case of the buffer circuit breaker, however, the compression volume 4 is separated from the low-pressure volume 5 by means of a valve 6. The low-pressure volume 5 is generally designed as an exhaust volume, but can also have a filling volume which is separated from the exhaust volume and in which is also stored fresh insulating gas which is largely free of exhaust gases after the opening of the circuit breaker.

With closing of the circuit breaker, a flow 12 is formed, directing the insulating gas from the low-pressure volume 5 through the valve 6 into the compression chamber 4 (part of FIGS. 1 and 1*a* located to the left of the axis 11). With opening of the circuit breaker, a flow 13 is formed as soon as the compression volume 4 has an overpressure of at least two bar in relation to the low-pressure volume 5. This flow directs compressed insulating gas, serving as quenching gas, from the compression volume 4 in the reverse direction into the low-pressure volume 5 (part of FIGS. 1 and 1*a* located to the right of the axis 11).

From FIG. 1*a* it is seen that the valve 6 has the following elements:

- a valve body 30 which is guided through a wall of the compression chamber 4, with a gas passage 31 which connects the compression volume 4 and the low-pressure volume 5, and a valve seat 32 which encompasses the gas passage,
- a valve plate 9 which is operated by the insulating gas, is movably mounted in the valve body 30, and sits on the valve seat 32 in a gastight manner when the circuit breaker opens (right-hand half of FIG. 1*a*), and also
- a stop 8 integrated into the valve body 30, which limits the movement of the valve plate 9 towards the top with closing of the circuit breaker (left-hand half of FIG. 1*a*) and is arranged on the side of the valve plate 9 facing away from the valve seat 32. The position of the stop 8 determines the maximum distance by which the valve plate 9 can be lifted from the valve seat 32.

The valve plate 9 is clearly designed as an annular disk which is directed around the longitudinal axis 11 of the circuit breaker 1.

From FIG. 1*a* it is seen that the valve plate 9 has a hole 71 and a leaf spring 7 which is fastened on one side and is elastically bendable in dependence upon the pressure of the insulating gas in the compression volume 4.

The circuit breaker 1 according to the invention also comprises a lower element 21, which comprises a piston of the compression device, and an upper element 20, which comprises a cylinder of the compression device. In the depicted exemplary embodiment, the upper element 20 is movably arranged in the direction of the longitudinal axis 11 and the lower element 21 is fixed. With separation of the two arcing contacts 2*a* and 2*b*, the upper element 20, on which is attached the arcing contact 2*a*, is displaced in the direction away from the second arcing contact 2*b*.

Figure 2:
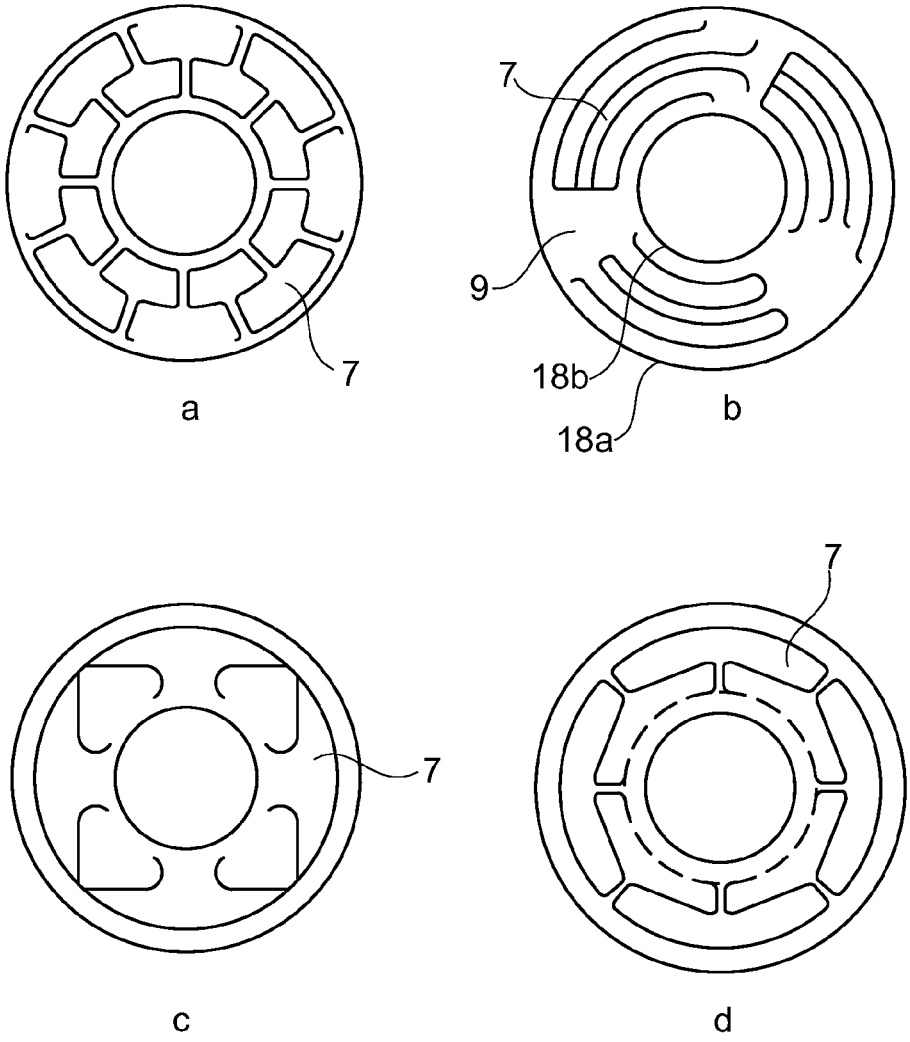

FIG. 2 shows in Figures a to d different embodiments of the valve plate 9. In these examples, the valve plates 9 are constructed in each case as an annular disk with an outer edge 18*a* and an inner edge 18*b*. The shapes, which result from the lines shown inside the edges 18*a*, 18*b*, correspond to a plurality of leaf springs 7. Each leaf spring 7 is cut into the annular disk over the entire thickness of the annular disk. The lines indicate the incisions into the material of the annular disk.

The valve plate 9 can be exchanged for another valve plate 9 of different thickness and differently shaped leaf springs 7 and holes 71. This allows adaptation of the circuit breaker 1 according to the invention to subsequently explained parameters, such as gas passage volume and threshold value of the overpressure.

The shapes of the leaf springs 7 are associated with the desired maximum gas passage volume in the case of the flow 13. As seen in FIG. 2, the circumference of the incisions, which form the leaf springs 7, determines the flow cross section of a flow passage which is directed through the valve plate and receives the flow 13. With a given magnitude of the overpressure, the gas passage volume per unit of time can be varied by suitable selection of the circumference of the leaf springs 7 or by selection of the size of the flow cross section.

If the thickness of the valve plate 9 is varied, then the spring constant of the leaf spring 7 is altered, the leaf spring 7 preferably having the same thickness as the valve plate 9. A thicker leaf spring 7 brings about a higher spring constant or a higher elastic restoring force and a thinner leaf spring 7 brings about a lower spring constant or a lower elastic restoring force. The spring constant or thickness of the leaf spring 7, together with the length of the leaf spring (distance between the attachment on the material of the annular disk 9 and the free end of the spring 7) substantially determines the response behavior of the valve 6 in relation to the occurrence of overpressure in the compression volume 4. In the case of a higher spring constant, a higher overpressure is required in order to deflect the leaf spring 7. Correspondingly, in the case of a lower spring constant a lower overpressure is required. The thickness and the length or shape of the leaf spring 7 are variable, as a result of which the desired threshold value of the overpressure can be adjusted for realization of the flow 13.

An elastic restoring force or spring constant can therefore be adjusted by an elasticity and/or shape of the leaf spring 7 being selected in accordance with a predeterminable threshold value of the overpressure, and a defined flow cross section through the valve plates 9 can be selected in accordance with a predeterminable gas passage volume. As a result, by the exchange of differently shaped valve plates 9 the maximum gas passage volume and the threshold value of the overpressure for the realization of the flow 13 in the circuit breaker 1 are also adjustable in the simplest way.

The circuit breaker 1 can be designed for use as an outdoor circuit breaker or as a metal-encapsulated circuit breaker.

In a preferred embodiment (FIGS. 3 and 4), the valve plate 9, which is preferably designed as an annular disk, has at least one leaf spring 7 which has been cut into the valve plate or annular disk as a circular ring section with regard to the middle point of the valve plate or annular disk with one radial incision 72 and two concentric incisions 73, 74.

Figure 3:
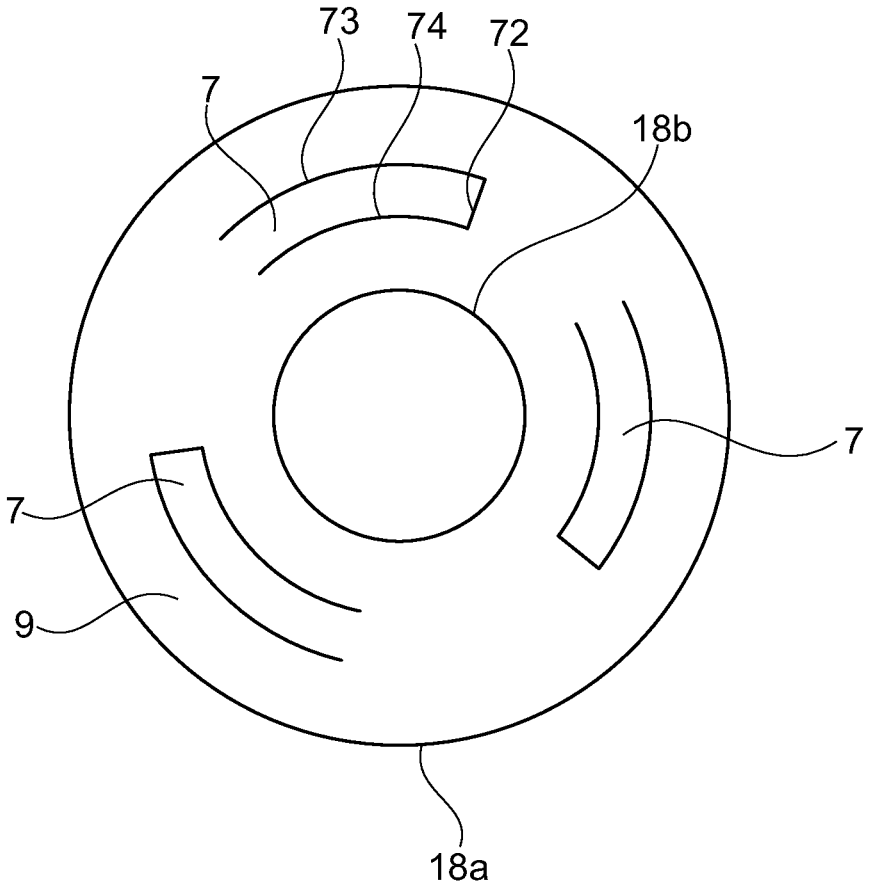

In the exemplary embodiment according to FIG. 3, the annular disk has three leaf springs 7.

Figure 4:
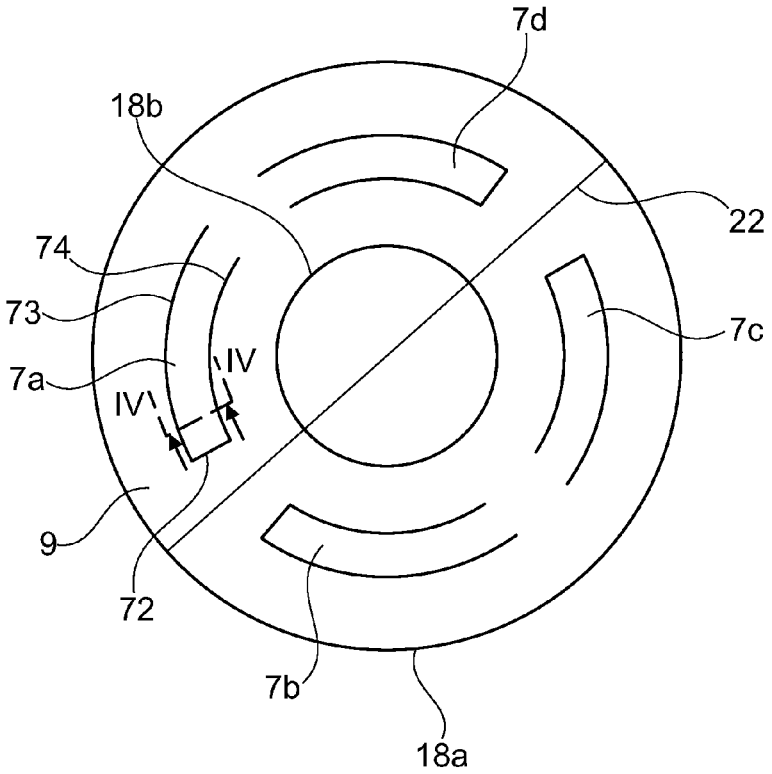

In the embodiment according to FIG. 4, the annular disk 9 has an even number, that is to say at least two, leaf springs 7 which, as explained above, have also been cut in each case into the annular disk as circular ring sections with regard to the middle point of the annular disk with one purely radial incision 72 and two concentric incisions 73, 74 in each case. Each two of the leaf springs are arranged in a mirror-image manner in relation to each other with regard to a diameter line 22 of the annular disk. In FIG. 4, four leaf springs 7*a*, 7*b*, 7*c*, 7*d* are shown, wherein a first leaf spring 7*a* and a second leaf spring 7*b*, or a third leaf spring 7*c* and a fourth leaf spring 7*d*, are arranged in each case in a mirror-image manner in relation to each other with regard to the diameter line 22 of the annular disk. This embodiment of the valve plate 9 especially prevents a propeller effect which could occur in the case of an orientation of all the spring elements in the clockwise direction or anticlockwise direction. In other words, the opposed orientation of each two spring elements prevents the possibility of the annular disk being set in a rotational movement when the gas flow 13 is formed.

Depending upon the dimensioning of the self-blast circuit breaker 1 according to the invention, an uneven number of leaf springs can naturally also be selected. For example, an annular disk according to FIG. 3 could also have two leaf springs 7 arranged in an opposed manner, wherein the orientation of the non-associated leaf springs would play no role since friction forces would adequately counteract a remaining tendency towards rotation of the annular disk.

If the circuit breaker according to the invention is constructed as a self-blast circuit breaker then the check valve prevents hot arc gases, flowing into the heating volume 19, being able to enter into the compression volume 4. The valve 6 is therefore not subjected to any excessively high temperatures. The valve plate 9, and correspondingly also the at least one leaf spring 7, can therefore be formed from a standard spring steel. Especially suitable is a standard spring steel which is realized as an unalloyed or low-alloy high-grade steel, such as a high-grade steel which is commercially available under the short name of C60S, C75S or 51CrV4.

Figure 5:
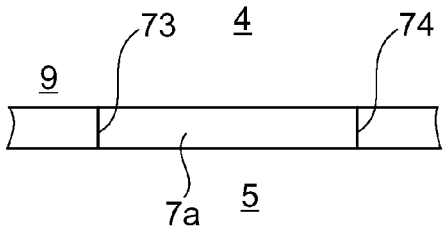
FIG. 5 shows a top view in the direction of the arrow of a section directed along IV-IV through the embodiment of the valve plate according to FIG. 4.

The incisions 72 to 74, as seen in FIG. 5, are generally directed perpendicularly to the surface of the valve plate 9. No particularly high demands are made upon the cutting tool so that the valve plate 9 and, as a result, also the circuit breaker 1, can then be produced in a particularly economical manner.

Figure 6:
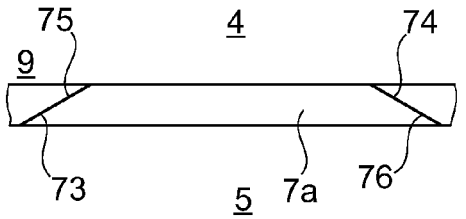
FIG. 6 shows a top view in the direction of the arrow of a section directed along IV-IV through a modified embodiment of the valve plate according to FIG. 4.

As seen in FIG. 6, the incisions 72 to 74 can also be directed in an inclined manner in relation to the surface of the valve plate 9. The inclination angle, in relation to the surface of the valve plate 9, is dimensioned so that the leaf springs 7 bend when the overpressure of at least 2 bar is reached and can open the hole 71. Below this pressure limit value, the leaf spring, with an obliquely beveled outer edge 76 which determines its contour, rests on an inner edge 75 which is formed with an opposite inclination and determines the contour of the hole 71. If the inclination angle, starting from the 90° vertical section, is less than 60°, typically less than 50° and larger than 20°, then the width of the edges 75, 76 is effectively extended and the leakage losses in the compression chamber 4 are correspondingly reduced. Moreover, unavoidable oscillations of the leaf springs 7 are damped more intensely than in the case of the embodiment according to FIG. 5. The hole 71 can now open in a defined manner in a direction which enables the forming of the flow 13. Furthermore, a pretension can now also act upon the leaf spring 7 which even in the case of relatively high threshold values of the overpressure, of 6 or 10 bar, for example, enables a very fast-initiating discharging of the compression volume 4 through the hole 71.

The circuit breaker according to the invention acts as follows:

In the closed circuit breaker, current flows in a current circuit which includes the closed contacts 2*a* to 2*d*. Before a switching action, all volumes are typically filled with the gas of equal pressure. Pressure differences and gas flows, such as the flows 12 or 13, only occur as a result of a switching action, that is to say with opening of the circuit breaker and the separating of the contacts 2*a* to 2*d* which is associated therewith, for example.

With disconnection of the current circuit, i.e. in the case of a movement of the upper element 20 in the direction of the longitudinal axis 11 away from the second arcing contact 2*b*, the nominal current contacts 2*c*, 2*d* are first of all separated, as a result of which the current commutates completely into a current circuit which includes the arcing contacts 2*a*, 2*b*. With further movement of the upper element 20, the arcing contacts 2*a*, 2*b* are now also separated and the arc 15 is created. With further movement of the upper element 20, the arc 15 is extended. With separation of the arcing contacts 2*a*, 2*b*, as described above, the upper element 20 is displaced in the direction of the stationary lower element 21. As a result, the gas pressure in the compression volume 4 increases. As soon as it is higher than in the heating volume 19, gas flows from the compression volume 4 through the check valve 14 into the heating volume 19, as a result of which the gas pressure in the heating volume increases.

Also, in the case of weak arcs 15, e.g. with interruption of operating currents, the gas volume increases as soon as the gas in the arcing zone 3 is basically heated up by means of an arc 15 which is created in the event of operation-dependent separation of the arcing contacts 2*a*, 2*b*. The gas pressure in the arcing zone 3, however, in the case of weak arcs 15, that is to say in the case of weak currents to be interrupted, remains lower than the gas pressure in the heating volume 19. Therefore, the gas always flows in this case from the compression volume 4 into the heating volume 19 and through the heating passage 17 into the arcing zone 3 where it blasts the arc 15 with zero crossing of current.

In the case of strong arcs 15, which can arise on account of a short circuit, for example, the gas in the arcing zone 3 quickly heats up on account of the high current intensity of the arc 15, as a result of which a sharp pressure increase in the heating volume 19 also occurs. With zero crossing of current, the pressure in the arcing zone quickly drops, as a result of which a pressure gradient between arcing zone 3 and heating volume 19 is created. As a consequence, gas flows from the heating volume 19 through the heating passage 17 back into the arcing zone 3, as a result of which the arc 15 is intensively blasted and quenched. On account of the sharp pressure increase in the heating volume 19, which exceeds the gas pressure in the compression volume 4, the check valve 14 closes and no more gas flows from the compression volume 4 into the heating volume 19. The pressure in the compression volume 4 increases further during the downward movement of the upper element 20 until the pressure of the compressed insulating gas in the compression chamber 4 exceeds the value of the gas pressure in the low-pressure chamber 5 by at least two bar. Above this overpressure, the leaf spring 7 opens the hole 71 and then limits a flow passage, guided through the hole 71, for insulating gas which discharges from the compression volume 4. With the opening of the hole 71, the leaf spring 7, which is clamped on one side, is elastically deflected downward into the low-pressure volume 5 and so forms the flow passage for the flow 13 which is directed from the compression volume 4 into the low-pressure volume. An unacceptably high overpressure in the compression chamber 4 is thus avoided. At the same time, the compression operation, which is to be applied by the drive A, is also limited as a result. This ensures the overpressure operation of the valve 6 which is shown in the right-hand half of FIGS. 1 and 1*a*. As soon as the pressure in the compression volume 4 is reduced again below the limit value of 2 bar, the leaf spring 7 returns again to its original position in which it closes off the hole 71.

With closing of the arcing contacts 2*a*, 2*b*, the upper element 20 is moved in the direction of the arcing contact 2*b*. As a result, in the compression volume 4 a negative pressure is created in relation to the low-pressure volume 5. This leads to the valve plate 9 lifting from the valve seat 32 and being able to direct the flow 12 of now fresh insulating gas from the low-pressure volume 5 into the compression volume 4. With this, the filling operation of the valve 6, which is shown in the left-hand half of FIG. 1 and FIG. 1*a* respectively, is ensured. During the filling, the stop 8 ensures that the movement of the valve disk 9 towards the top is limited.

What is claimed:

1. A gas-insulated high-voltage power circuit breaker, comprising a compression device, operated by a drive of the circuit breaker, with a compression volume which is filled with insulating gas and in which the insulating gas is compressed, forming quenching gas, when the circuit breaker opens, a low-pressure volume which is filled with insulating gas, and a valve which interconnects the compression volume and the low-pressure volume, through which valve insulating gas flows from the low-pressure volume into the compression volume when the circuit breaker closes and through which insulating gas flows from the compression volume in the reverse direction into the low-pressure volume when the circuit breaker opens above a threshold value of the quenching gas pressure, in which the valve has the following elements:

a valve body, which is guided through the wall of the compression chamber, with a gas passage which connects the compression volume and the low-pressure volume and a valve seat which encompasses the gas passage, a valve plate which is operated by the insulating gas, is movably mounted in the valve body, and sits on the valve seat when the circuit breaker opens, and also a stop which is integrated into the valve body and limits the movement of the valve plate when the circuit breaker closes, characterized in that the valve plate has at least one hole and at least one leaf spring which is fastened on one side, is elastically bendable in dependence upon the pressure of the insulating gas in the compression volume, closes off the hole when the circuit breaker closes, opens the hole when the circuit breaker opens, and limits a flow passage, which is guided through the hole, for the insulating gas which discharges from the compression volume as soon as the pressure of the compressed insulating gas in the compression volume exceeds the value of the gas pressure in the low-pressure chamber by at least two bar.

2. The circuit breaker as claimed in claim 1, characterized in that the leaf spring is formed into the valve plate by means of at least one incision.

3. The circuit breaker as claimed in claim 2, characterized in that the at least one incision is directed perpendicularly to the surface of the valve plate.

4. The circuit breaker as claimed in claim 3, characterized in that at least one section of the at least one incision is directed in an inclined manner in relation to the surface of the valve plate.

5. The circuit breaker as claimed in claim 4, characterized in that the inclination angle is 60° at most.

6. The circuit breaker as claimed in claim 1, characterized in that the valve plate is produced from a spring steel sheet, the thickness of which in relation to the length of the leaf spring is selected so that with bending of the leaf spring a plastic deformation is avoided and the hole is opened when the threshold value is exceeded.

7. The circuit breaker as claimed in claim 1, characterized in that the valve plate is designed as an annular disk, and in that the at least one leaf spring is constructed as a circle section with regard to a middle point of the annular disk and has at least three sides which are cut into the annular disk, of which at least one is radially oriented and at least two are directed concentrically.

8. The circuit breaker as claimed in claim 7, characterized in that the annular disk has a multiplicity of leaf springs which are formed in each case as a circle section with regard to the middle point of the annular disk and have in each case at least three sides which are cut into the annular disk, of which at least one is radially oriented and at least two are directed concentrically, wherein each two of the leaf springs are arranged in a mirror-image manner in relation to each other with regard to a diameter line of the annular disk.

9. The circuit breaker as claimed in claim 1, with a heating volume, connected to the compression chamber via a check valve, for receiving arc gases, characterized in that the valve plate and the at least one leaf spring are formed from a standard spring steel.

10. The circuit breaker as claimed in claim 9, characterized in that the standard spring steel is an unalloyed or low-alloy high-grade steel.

11. The circuit breaker as claimed in claim 10, characterized in that the high-grade steel is a material which is commercially available under the short name of C60S, C75S or 51CrV4.

12. The circuit breaker as claimed in claim 1, characterized in that the elastic bending of the leaf spring is limited solely by means of the restoring force of the leaf spring without the use of a stop.

* * * * *